US011650032B2

(12) United States Patent
Gilman et al.

(10) Patent No.: US 11,650,032 B2
(45) Date of Patent: May 16, 2023

(54) SINGLE-USE SHELL CASING

(71) Applicants: Steven A. Gilman, Brooklyn, CT (US); Mark D. Lorusso, Portsmouth, NH (US); Mark F. Scribner, Cape Elizabeth, MA (US)

(72) Inventors: Steven A. Gilman, Brooklyn, CT (US); Mark D. Lorusso, Portsmouth, NH (US); Mark F. Scribner, Cape Elizabeth, MA (US)

( * ) Notice: Subject to any disclaimer, the term of this patent is extended or adjusted under 35 U.S.C. 154(b) by 384 days.

(21) Appl. No.: 16/703,740

(22) Filed: Dec. 4, 2019

(65) Prior Publication Data

US 2020/0240756 A1 Jul. 30, 2020

Related U.S. Application Data

(60) Provisional application No. 62/774,911, filed on Dec. 4, 2018.

(51) Int. Cl.
*F42B 5/26* (2006.01)
*F42C 19/08* (2006.01)

(52) U.S. Cl.
CPC ..... *F42B 5/26* (2013.01); *F42C 19/083* (2013.01)

(58) Field of Classification Search
CPC .... F42B 5/00; F42B 5/02; F42B 5/025; F42B 5/26; F42B 5/28; F42C 19/08; F42C 19/0823; F42C 19/083
USPC ..... 102/464, 469, 470
See application file for complete search history.

(56) References Cited

U.S. PATENT DOCUMENTS 3,200,746 A 8/1965 McConeghy
3,431,853 A * 3/1969 Allen ..... F41C 3/00 102/370
3,952,657 A 4/1976 Kallman
5,048,423 A 9/1991 Garrett
(Continued)

FOREIGN PATENT DOCUMENTS

EP 2 795 236 B1 3/2017

OTHER PUBLICATIONS

International Search Report for PCT/US2019/64547 (dated 2020).*
(Continued)

*Primary Examiner* — James S Bergin
(74) *Attorney, Agent, or Firm* — Lorusso & Associates

(57) ABSTRACT

A modified bullet cartridge having a score line formed around a primer bore. The score line may be positioned symmetrically or asymmetrically about the primer bore. The score line may have a regular or irregular two-dimensional geometric shape. A modified bullet cartridge having a counter-bore formed superposed about a primer bore. The counter-bore may have a vertical counter-bore extension and/or a radial counter-bore extension. Adhesive is positioned in the counter-bore about a primer secured in the primer bore. The primer may have a radial flange extending radially from an exterior sidewall of the primer. The flange registers against a bottom surface of the counterbore, or within a radial flange extension if present. Adhesive is used to lock the primer flange against the counter-bore and/or radial counter-bore extension. The combination of the counter-bore, adhesive and optionally the flanged primer locks the primer to the bullet cartridge to render the cartridge unusable after one use. The bullet cartridge is rendered waterproof with the use of the adhesive.

12 Claims, 6 Drawing Sheets

(56) References Cited

U.S. PATENT DOCUMENTS

| | | | | |
|---|---|---|---|---|
| 5,259,288 | A * | 11/1993 | Vatsvog | F42B 5/307 102/467 |
| 6,460,464 | B1 * | 10/2002 | Attarwala | F42B 5/36 102/470 |
| 7,610,858 | B2 | 11/2009 | Chung | |
| 8,156,870 | B2 * | 4/2012 | South | F42B 33/04 102/464 |
| 8,915,004 | B1 | 12/2014 | Langner | |
| 9,429,407 | B2 | 8/2016 | Burrow | |
| 10,119,799 | B2 * | 11/2018 | Kuchman | F42B 5/26 |
| 10,345,067 | B2 * | 7/2019 | Brown | F41A 17/42 |
| 10,578,409 | B2 * | 3/2020 | Burrow | F42B 33/001 |
| 2007/0261587 | A1 | 11/2007 | Chung | |
| 2011/0048269 | A1 | 3/2011 | Schuster | |
| 2012/0111219 | A1 | 5/2012 | Burrow | |
| 2016/0018199 | A1 | 1/2016 | Nemec | |
| 2016/0069654 | A1 | 3/2016 | Walsh | |
| 2016/0356588 | A1 | 12/2016 | Burrow | |
| 2017/0322004 | A1 | 11/2017 | Kuchman | |
| 2018/0135953 | A1 | 5/2018 | Bruno | |

OTHER PUBLICATIONS

Written Opinion of the International Searching Authority for PCT/US2019/64547 (dated 2020).*

Author Unknown, New PolyCase Ammunication and Injection-Molded Bullets, website article, Jan. 11, 2015.

Mary Carr Mayle, Manufacturer of the year: PolyCase on fast track to success, Savannah Morning News, Dec. 23, 2014.

* cited by examiner

SINGLE-USE SHELL CASING

CROSS-REFERENCE TO RELATED APPLICATIONS

This U.S. Regular Utility Application claims the benefit of U.S. Provisional Application Ser. No. 62/774,911 filed Dec. 4, 2018, the contents of which are incorporated herein by reference.

FIELD OF THE INVENTION

This disclosure relates generally to bullet shells. More particularly, the disclosure relates to single-use bullet casings that cannot be reassembled for additional use.

BACKGROUND OF THE DISCLOSURE

In today's chaotic world with wars raging both domestically and internationally, ammunition used by warfighters and law enforcement, regardless of caliber, comprises bullets made from various materials, but with a generalized structure. As shown in FIGS. 1 and 2, a common bullet construction includes a cylindrical hollow cartridge or bullet casing shown generally as 1 having a housing wall 2 secured to a cartridge base 5 with a primer bore that houses a primer 4 with a firing pin 6 in the primer. Explosive powder (charge) (not shown) fills the cartridge and a projectile or bullet (not shown) is secured to the open end of the cartridge. In addition to the common bullet structure, there are two subcategories of casings: center fire and rim fire. Center-fire cartridges have the primer positioned at the center of the cartridge base. Rim-fire cartridges have the primer positioned with the annular rim of the junction of the cartridge sidewall and cartridge base.

Regardless whether a cartridge is structured as a center fire or rim fire version, the primer is commonly a modular component press fit into a bore formed in the cartridge base. This permits removal of the spent primer module after the cartridge is fired. Depending in part on the material used to construct the cartridge, a spent primer cartridge may be removed from the fired casing and replaced with a new primer. Bullet casings can be designed to undergo multiple cycles of firing and reloading before structural degradation eliminates further use.

To fire a bullet, a gun trigger is pulled that activates a hammer or plunger that strikes the firing pin. The firing pin causes the primer to explode. The explosion ignites the powder or charge, which also explodes and creates an intense, localized pressure wave that forces the projectile or bullet out of the gun. Shell casings can be made from a variety of materials, with aluminum and brass being two common materials used. One advantage of brass casings permits the reuse of the casing. A user simply pops out the spent firing pin with a press and inserts a new primer. This permits the same cartridge to be used multiple times. This advantage, unfortunately, also is a significant disadvantage in war zones and high crime areas.

In conflict settings, use of shell casings amenable to re-use creates a significant problem for warfighters and law enforcement. Rapid discharge of multiple rounds of ammunition and rapid movement of war fighters and law enforcement provide a potential advantage for enemy troops and criminals. Enemy combatants and criminals and their associates can collect spent shells, remove spent primers and install new primers in the spent shells to create new ammunition. This is particularly advantageous to enemy combatants and criminals that do not have the resources to constantly source and buy new ammunition. To counter this, military troops and law enforcement personnel can collect spent shells after a fire fight—a very laborious, time-consuming and even dangerous activity, especially in an active war zone.

What is needed is a single-use cartridge that cannot be re-used and safely can be left on the battlefield. Attempts at creating such cartridges have been made. In one approach, cartridges have been constructed from polymer materials that deform when exposed to the high temperatures and pressures of ammunition discharge. Such cartridges become deformed and unusable. The use of polymers, however, results in a significant increase in cost that makes this approach economically unfeasible. What is needed and what we have created is a modified conventional bullet cartridge that cannot be used after firing. These and other objects of the disclosure will become apparent from a reading of the following summary and detailed description of the disclosure.

SUMMARY OF THE DISCLOSURE

In one aspect of the disclosure, a bullet cartridge is constructed with an annular continuous or segmented score line in the cartridge base. The score line functions as a weakened zone or fracture point that fails when someone attempts to remove a spent primer module. If the primer module is removed, the primer-receiving bore is distorted and enlarged to render the cartridge unusable since a new primer cannot be successfully secured to the distorted and enlarged bore.

In another aspect of the disclosure, the score line is randomized dimensionally and/or made geometrically eccentric to produce multiple different distortions to the primer bore if spent primers are removed from cartridges. This prevents the replacement of standardized primers in a cluster of spent bullet cartridges. Each randomized distortion can only be used if a specially dimensioned primer is constructed to accommodate the geometry of the distorted bore.

In a yet further aspect of the disclosure, a flat-bottom or radiused-bottom counter-bore is created about the primer bore. A heat, cold and UV light resistant adhesive is used to secure the primer to the cartridge base. The adhesive maintains registration of the primer to the cartridge base throughout the life of the cartridge. Any attempt to remove the spent primer will result in destruction of the cartridge base or distortion of the primer bore. Multiple adhesives having different properties may be used to support the primer in the enlarged primer bore.

In a further aspect of the disclosure, a counter-bore is produced around a primer bore. A primer is modified to have an annular flange about the leading edge of the primer. The primer and flange are seated in the primer bore. The flange occupies the space created by the counter-bore. Adhesive is applied to the counter-bore to cover the flange and to fill the void created by the counter-bore. The adhesive locks the flange into the bullet casing and prevents the primer from being removed.

In a still further aspect of the disclosure, a counter-bore is produced around a primer bore. A secondary annular bore is formed about the annular perimeter of the counter-bore, deeper than the counter-bore depth. The secondary annular bore creates a weakened zone in the bullet casing base. Adhesive is poured into the secondary annular bore and counter-bore to strengthen the weakened zone and to support the resident primer. The thinned bullet casing material under the secondary annular bore functions as a fracture point that fails when a spent primer is urged out of the casing. Should the primer be removed, the part of the casing base within the secondary annular bore will break off with the primer. This creates an over-sized primer bore without any primer registration surface or seat to receive a new primer.

In another aspect of the disclosure an expandable adhesive is used to fill a counter-bore formed about a primer bore in a bullet casing. The adhesive is placed in the counter-bore after a primer has been set in the casing. When a spent primer is removed, the adhesive expands into the primer bore and occludes the primer bore and thereby prevents the insertion of a new primer.

In yet another aspect of the disclosure, a counter-bore is formed about a primer bore in a bullet casing. A secondary annular radial bore is formed at the bottom of the counter-bore wall that extends radially outwardly from the counter-bore wall to create a mechanical engagement surface for adhesive poured into the counter-bore. Adhesive that flows into the secondary annular radial bore locks the adhesive in the counter-bore. Any attempt to remove a spent primer results in the primer being distorted without any removal of the adhesive.

In a further aspect of the disclosure, a primer is formed with a flexible annular flange at or about the leading edge of the primer. A counter-bore is formed about a primer bore in a bullet casing. A secondary annular radial bore is formed at the bottom of the counter-bore wall that extends radially outwardly from the counter-bore wall. The primer is inserted into the primer bore and the flexible flange registers against the counter-bore wall as the primer is being inserted into the bore and flexes out into the secondary annular radial bore to create an additional mechanical lock for the primer. The remainder of the counter-bore can be filled with adhesive to further secure to the primer to the bullet casing.

In yet another aspect of the disclosure, a method of creating an enlarged primer bore includes boring a secondary larger-diameter bore about a bullet casing primer bore with a depth that does not exceed the primer bore depth and that leaves the central primer seat of the primer bore intact. The method further includes the step of inserting and securing a primer to the bullet casing and depositing adhesive in the counter-bore to lock in the primer. An annular adhesive deposition head includes an annular adhesive delivery channel that has an inner diameter slightly greater than the diameter of the primer and an outer diameter slightly smaller than the diameter of the counter-bore. These and other aspects of the disclosure will become apparent from a review of the appended drawings and a reading of the following detailed description of the disclosure.

DETAILED DESCRIPTION OF THE DISCLOSURE

Figure 1:
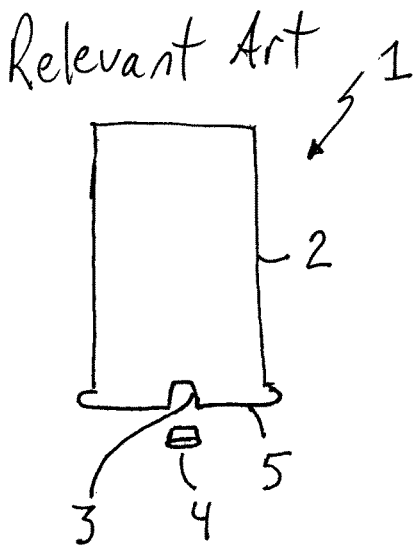
FIG. 1 is a side sectional view in elevation of a conventional bullet casing with a primer separate from the casing.
Figure 2:
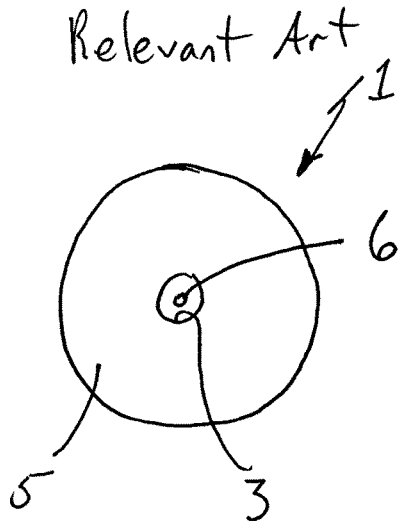
FIG. 2 is a bottom view of the bullet casing shown in FIG. 1.
Figure 3:
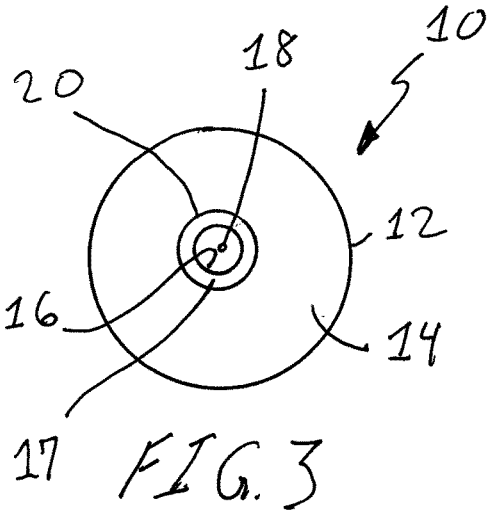
FIG. 3 is a bottom view of a bullet casing with a score line about a primer bore according to one embodiment of the disclosure.
Figure 4:
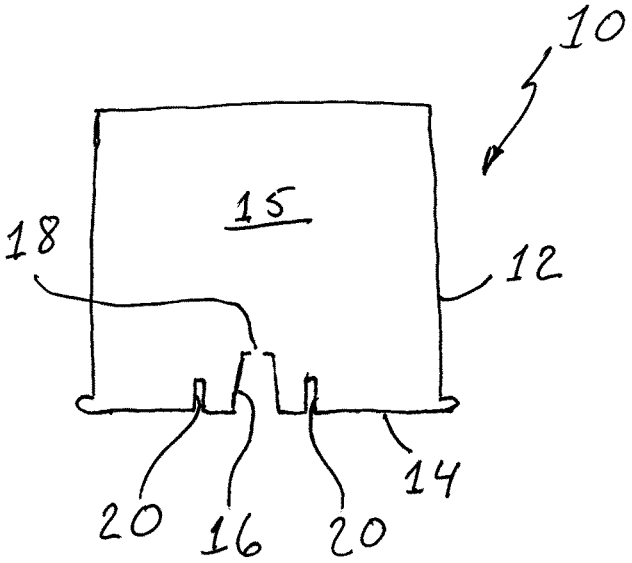
FIG. 4 is a side sectional view in elevation of the bullet casing shown in FIG. 3.

Referring to FIGS. 3 and 4, a bullet casing, shown generally as 10, includes a substantially cylindrical wall 12 secured to a circular base 14. The combination of wall 12 and base 14 form a powder chamber 15 designed to hold an explosive material such as gun powder. A primer bore 16 is formed substantially within the center of base 14. Primer bore 16 extends partially into the thickness of base 14 and has a bottom used as a registration surface for a primer. Primer bore 16 includes a primer through-bore 18 that permits communication between the contents of a primer and the bullet casing chamber 15.

An annular score line 20 is formed about the primer bore 16. Score line 20 extends partially into the thickness of cartridge base 14 to create a weakened zone about primer bore 16. This weakened zone is dimensioned with respect to depth so as not to reduce the integrity of base 14 before a live cartridge is fired. Firing of the cartridge weakens the cartridge base at the score line. When force is applied to the spent primer to remove it, the portion of base 14 that forms the bottom of the score line fails and a portion 17 of the base between the score line and the primer is removed with the primer. This renders the cartridge unusable for reloading operations.

Figure 5:
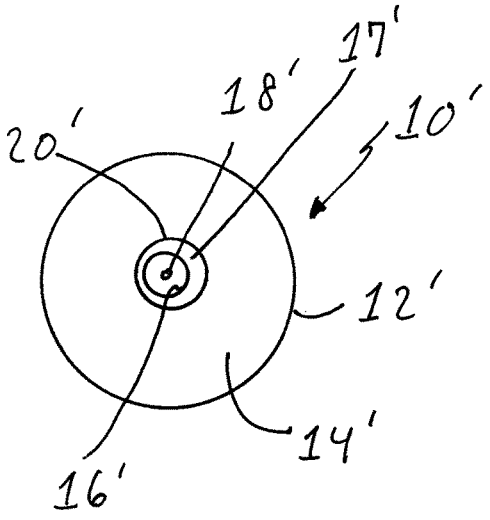
FIG. 5 is a bottom view of a bullet casing with an offset score line according to another embodiment of the disclosure.

Referring now to FIG. 5, in another aspect of the disclosure, a bullet cartridge shown generally as 10' includes a cylindrical cartridge wall 12' secured to a base 14'. For purposes of this disclosure, any element identified by a primed number is similar to other elements identified by the same number in an unprimed or differently primed form. A primer bore 16' is formed in the base with a pinhole bore 18' that permits communication between the contents of a primer and the main chamber of the cartridge. An offset score line 20' is formed asymmetrically about primer bore 16'. Score line 20' shares many of the same features as score line 20 in that the line does not penetrate the cartridge base and does not compromise the structural integrity of the base when the cartridge is fired. Upon any attempt to remove the primer, score line 20', now weakened by the discharge of the cartridge, fails such that a portion of the base 17' between the score line and the primer bore separates from the cartridge base. This renders the cartridge unusable. The asymmetry of the score line relative to the primer bore may be modified from one shell to another with respect to dimension, e.g., diameter, shape and offset. This results in shells having dimensionally different tear-out pieces when attempts are made to remove spent primers. With different tear-out voids, any attempt to make size-specific plugs or primers to reuse damaged cartridges is rendered difficult on a mass-production scale.

Figure 6:
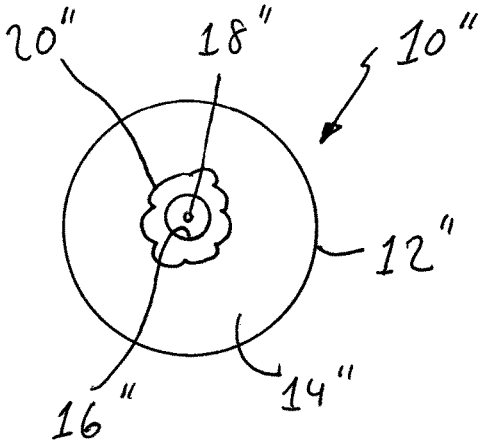
FIG. 6 is a bottom view of a bullet casing with randomized score line according to a further embodiment of the disclosure.

Referring now to FIG. 6, in a further aspect of the disclosure, a bullet cartridge shown generally as 10" includes a cylindrical cartridge wall 12" secured to a base 14". A primer bore 16" is formed in the base with a pinhole bore 18" that permits communication between the contents of a primer and the main chamber of the cartridge. A geometrically randomized and optionally offset score line 20" is formed asymmetrically about primer bore 16". Score line 20" shares many of the same features as score lines 20 and 20' in that the line does not penetrate the cartridge base and does not compromise the structural integrity of the base when the cartridge is fired. Like the other score lines, discharge of the cartridge further weakens the material that forms the bottom of the score line. Upon any attempt to remove the primer, score line 20", now weakened by the discharge of the cartridge, fails such that a portion of the base 17" between the score line and the primer bore separates from the cartridge base. This renders the cartridge unusable. It should be understood that any two-dimensional regular or irregular geometric shape may be used to form the score line. The randomized score lines may also be made dimensionally different from one cartridge to another to further defeat any attempts to reuse the cartridges.

Figure 21:
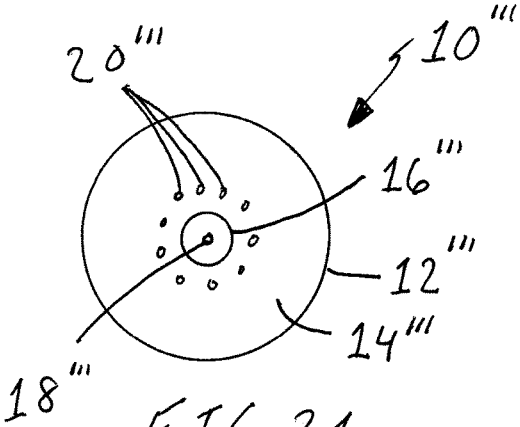
FIG. 21 is a bottom view of a bullet casing with a segmented score line according to another embodiment of the disclosure.
Figure 24:
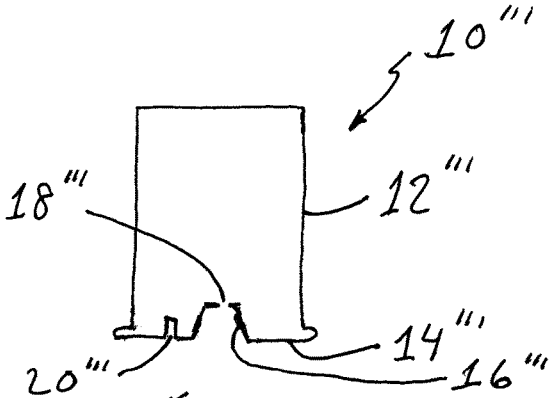
FIG. 24 is a side view in elevation of the bullet casing shown in FIG. 21.

Referring now to FIGS. 21 and 24, in a still further aspect of the disclosure, a bullet cartridge shown generally as 10''' includes a cylindrical cartridge wall 12''' secured to a base 14'''. A primer bore 16''' is formed in the base with a pinhole bore 18''' that permits communication between the contents of a primer and the main chamber of the cartridge. A segmented score line 20''' is formed substantially symmetrically about primer bore 16'''. Segmented score line 20''' shares many of the same features as score lines 20, 20' and 20" in that the line segments do not penetrate the cartridge base and do not compromise the structural integrity of the base when the cartridge is fired.

Figure 22:
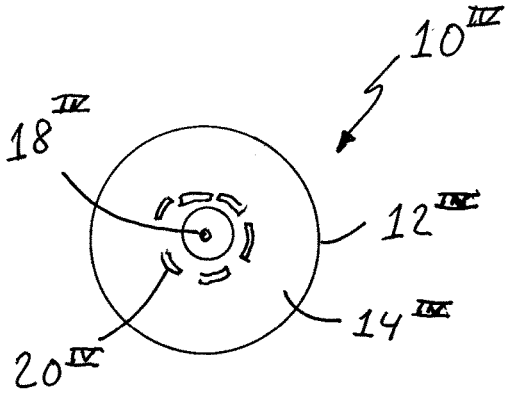
FIG. 22 is a bottom view of a bullet casing with a segmented score line comprised of elongated bore segments according to a further embodiment of the disclosure.

Referring now to FIG. 22, in yet another aspect of the disclosure, a bullet cartridge shown generally as $\mathbf{10}^{IV}$ includes a cylindrical cartridge wall $\mathbf{12}^{IV}$ secured to a base $\mathbf{14}^{IV}$. A primer bore $\mathbf{16}^{IV}$ is formed in the base with a pinhole bore $\mathbf{18}^{IV}$ that permits communication between the contents of a primer and the main chamber of the cartridge. A segmented score line $\mathbf{20}^{IV}$ is formed with a plurality of elongated score segments and is formed substantially symmetrically about primer bore $\mathbf{16}^{IV}$. Segmented score line $\mathbf{20}^{IV}$ shares many of the same features as segmented score line 20''' in that the line segments do not penetrate the cartridge base and do not compromise the structural integrity of the base when the cartridge is fired.

Figure 23:
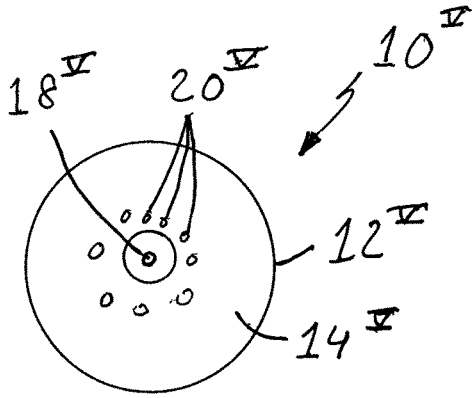
FIG. 23 is a bottom view of a bullet casing with an asymmetrically oriented segmented score line according to a yet further embodiment of the disclosure.

Referring now to FIG. 23, in a further aspect of the disclosure, a bullet cartridge shown generally as $\mathbf{10}^{V}$ includes a cylindrical cartridge wall $\mathbf{12}^{V}$ secured to a base $\mathbf{14}^{V}$. A primer bore $\mathbf{16}^{V}$ is formed in the base with a pinhole bore $\mathbf{18}^{V}$ that permits communication between the contents of a primer and the main chamber of the cartridge. A segmented score line $\mathbf{20}^{V}$ is formed with a plurality of score segments and is formed substantially asymmetrically about primer bore $\mathbf{16}^{V}$. Segmented score line $\mathbf{20}^{V}$ shares many of the same features as segmented score line 20''' in that the line segments do not penetrate the cartridge base and do not compromise the structural integrity of the base when the cartridge is fired. To create any of the segmented score lines disclosed herein, a punch rather than a boring bit is used.

For any score line, punches or coring bits are used to create the score lines. Punches are used for any score lines having geometrically irregular and non-circular shapes including ellipsoid shapes. Coring bits are used for circular-shaped score lines regardless of concentric orientation to the primer bore. Circular-shaped score lines are of particular advantage from a manufacturing perspective as such score lines can be created on bullet mass production lines such as Davenport machines.

Figure 7:
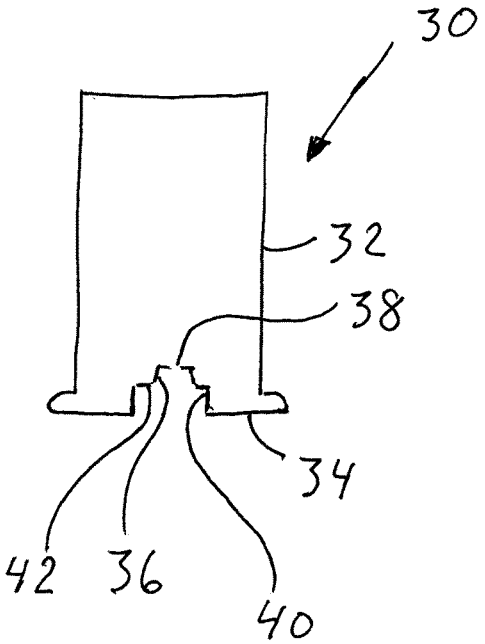
FIG. 7 is a side sectional view in elevation of a bullet casing with a primer counter-bore superposed about a primer bore according to yet another embodiment of the disclosure.
Figure 8:
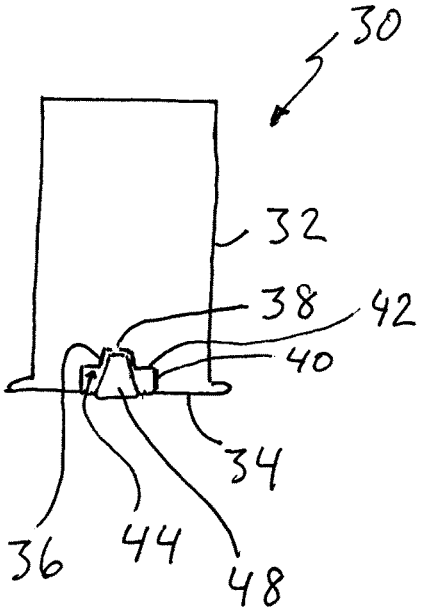
FIG. 8 is a side sectional view in elevation of the bullet casing shown in FIG. 7 with a primer secured to the bullet casing primer bore surrounded by adhesive in the primer counter-bore.

Referring now to FIGS. 7 and 8, in another aspect of the disclosure, a bullet cartridge shown generally as 30 has a cylindrical cartridge wall 32 secured to a cartridge base 34. A primer bore 36 is formed in base 34 with a primer through-bore 38 formed substantially centrally in a bottom surface of primer bore 36. A counter-bore 40 is formed superposed about primer bore 36. Counter-bore 40 has an annular counter-bore bottom surface 42 that defines the perimeter of primer bore 36. In one embodiment, counter-bore 40 is concentric with, and shares the same longitudinal axis as, primer bore 36. Counter-bore 40 may be positioned asymmetrically about primer bore 36 and may be formed with a regular or irregular geometric sidewall.

As shown in FIG. 8, a conventional primer 48 is secured in primer bore 36 using conventional primer installation procedures known well in the art. Counter-bore 40 is dimensioned to be intentionally shallower in depth than primer bore 36 to maintain a registration surface for primer 48 in the primer bore. Once a primer has been secured in the primer bore, an adhesive 44 is deposited about primer 48 in counter-bore 40 to further lock in the primer to bullet cartridge 30. Adhesive 48 may be derived from any aliphatic resin, polyurethane, epoxy or any other adhesive material that binds aggressively to the cartridge material (often brass) at a minimum. Adhesives with temperature resistance (heat resistance and cold resistance) properties are advantageous for this application. Binding aggressively to the primer material (often steel) is of further advantage. Adhesives that expand upon curing and have elastic properties in a cured state may be of particular advantage if a primer is successfully removed. With the primer removed, a structural impediment to adhesive expansion is removed. The compressed adhesive can expand at least partially into the primer bore to at least partially occlude the bore and render application of a new primer structurally hindered.

Use of aggressive adhesives renders removal of a spent primer difficult and virtually impossible to accomplish without rendering the bullet cartridge unusable. It has been determined that the combination of a primer counter-bore and adhesive creates a significant structural asymmetry when a primer is forcibly removed. Depending upon the cured properties of the adhesive, attempts to remove a primer secured with adhesive may result in only partial removal of a portion of the spent primer, or may result in the complete removal of the primer with an asymmetric portion of the adhesive. With either result, replacement of the spent primer with a new primer is rendered physically impossible due to the remaining primer segment(s) or the now hardened, geometrically irregular adhesive. Without a symmetrical, unobstructed primer bore, primer replacement cannot be achieved.

A further advantage of the counter-bore/adhesive embodiment is the creation of a waterproof cartridge shell. The adhesive in an uncured, fluid state, fills any micro-voids between the primer and the primer bore registration surface. This makes bullet cartridges constructed in this manner particularly suitable for use in water immersion settings such as military personnel performing underwater assignments with powder-actuated armaments.

Figure 25:
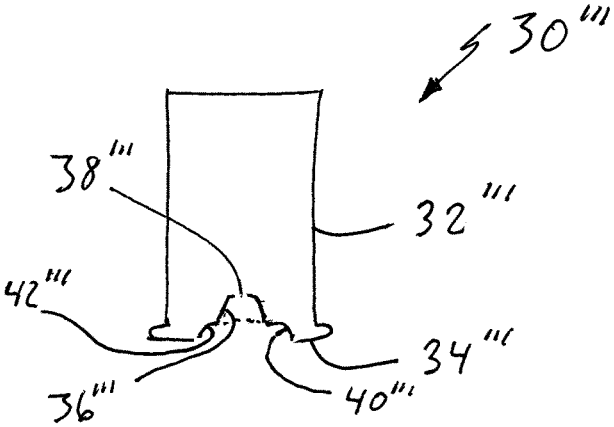
FIG. 25 is a side view in elevation and partial phantom of a radiused-bottom counter-bore according to yet another embodiment of the disclosure.
Figure 26:
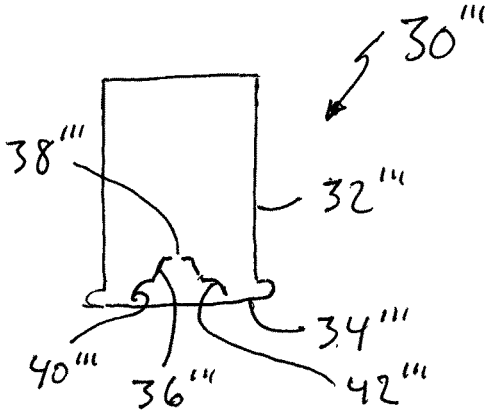
FIG. 26 is a second side view in elevation of the radiused-bottom counter-bore shown in FIG. 25.

Referring now to FIGS. 25 and 26, in yet another aspect of the disclosure, a bullet cartridge shown generally as 30''' has a cylindrical cartridge wall 32''' secured to a cartridge base 34'''. A primer bore 36''' is formed in base 34''' with a primer through-bore 38''' formed substantially centrally in a bottom surface of primer bore 36'''. A counter-bore 40''' is formed superposed about primer bore 36'''. Counter-bore 40''' has an annular radiused counter-bore bottom surface 42''' that defines the perimeter of primer bore 36'''. In one embodiment, counter-bore 40''' is concentric with, and shares the same longitudinal axis as, primer bore 36'''. Counter-bore 40''' may be positioned asymmetrically about primer bore 36''' and may be formed with a regular or irregular geometric sidewall. The use of a radiused-bottom counter-bore oriented symmetrically to the primer bore has proven to be advantageous during insertion of a primer as the radiused-bottom functions as a guide surface that urges the primer toward the center of the primer bore when being installed.

As shown in FIG. 26, a conventional primer 48''' is secured in primer bore 36''' using conventional primer installation procedures known well in the art. Counter-bore 40''' is dimensioned to be intentionally shallower in depth than primer bore 36''' to maintain a registration surface for primer 48''' in the primer bore. Once a primer has been secured in the primer bore, an adhesive 44''' is deposited about primer 48''' in counter-bore 40''' to further lock in the primer to bullet cartridge 30'''.

Figure 9:
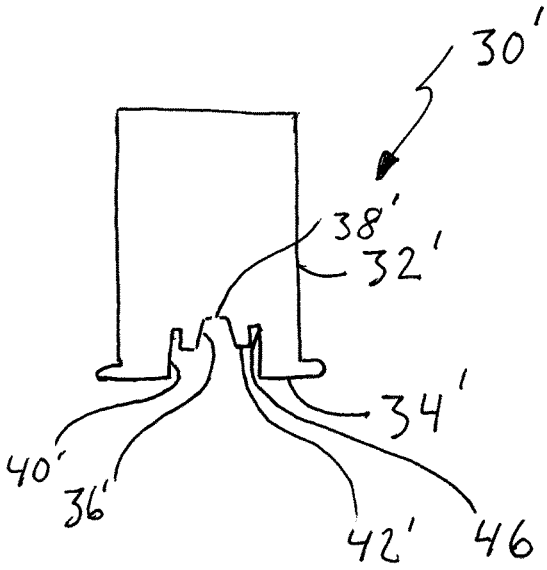
FIG. 9 is a side sectional view in elevation of a bullet casing with a primer counter-bore having an annular vertical bore extension according to a still further embodiment of the disclosure.
Figure 10:
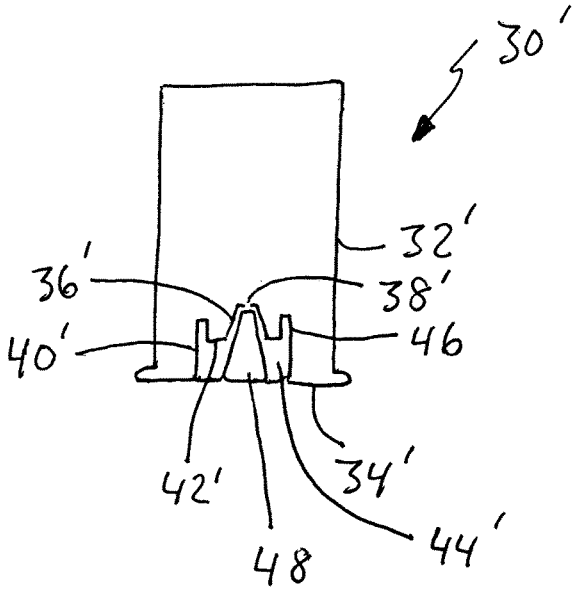
FIG. 10 is a side sectional view in elevation of the bullet casing shown in FIG. 9 with a primer secured to the bullet casing primer bore surrounded by adhesive in the primer counter-bore and annular vertical bore extension.

Referring now to FIGS. 9 and 10, in a further aspect of the disclosure, a bullet cartridge 30' includes a cylindrical cartridge wall 32' secured to a cartridge base 34'. The combination of the cartridge wall and cartridge base form an open chamber configured to receive granular explosive materials. A primer bore 36' is formed in cartridge base 34' and defines a primer through-bore 38' that permits communication between the contents of a primer secured to the bullet cartridge and the open chamber.

A primer counter-bore 40' is formed superposed about primer bore 36' with a counter-bore base 42' dimensionally set to be shallower than the depth of primer bore 36'. In this embodiment, an annular vertical bore extension 46 is formed along the perimeter of primer counter-bore 40'. Vertical bore extension 46 creates an annular weakened zone in cartridge base 34'. Unlike the score-line embodiments disclosed herein, vertical bore extension 46 is filled with adhesive that substantially restores the structural and functional integrity of cartridge base 34'.

As shown in FIG. 10, when a conventional primer 48 is secured in primer bore 36', adhesive 44' is placed in primer counter-bore 40' and vertical bore extension 46 to further secure primer 48 to cartridge base 34'. Once adhesive 44' cures, the added adhesive in vertical bore extension 46 increases the strength or "hold" of the adhesive to the cartridge base by providing an additional mechanical interference fit. This is designed to thwart any attempts to chip out the cured adhesive with sharp implements such as awls. Attempted removal of a spent primer should produce the same results as disclosed for the bullet cartridge 30 embodiment. Either the spent primer is only partially removed, or fully removed with an asymmetric section of cured adhesive. The remaining primer bore is now either partially occluded by any remaining primer segments, or rendered asymmetrical due to adhesive tear-out. In either condition, the bullet cartridge is rendered unusable as a new primer cannot be inserted successfully in an asymmetric or occluded primer bore.

Figure 11:
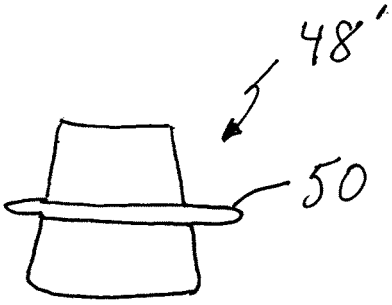
FIG. 11 is a side sectional view in elevation of a primer with a radial flange according to another embodiment of the disclosure.
Figure 12:
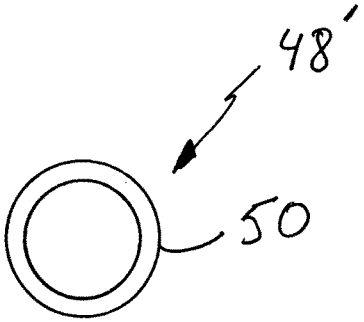
FIG. 12 is a bottom view of the flanged primer shown in FIG. 11.

Referring now to FIGS. 11 and 12, in a yet further aspect of a disclosure, a modified primer shown generally as 48' includes an annular primer flange 50 positioned on the primer that extends radially outwardly from the primer outer wall. Primer flange 50 provides an extra binding surface for the bullet cartridge embodiments disclosed herein that incorporate a primer counter-bore with adhesive. Primer flange 50 also permits the creation of a mechanical interference fit to further thwart removal of a spent primer from a bullet cartridge.

Figure 13:
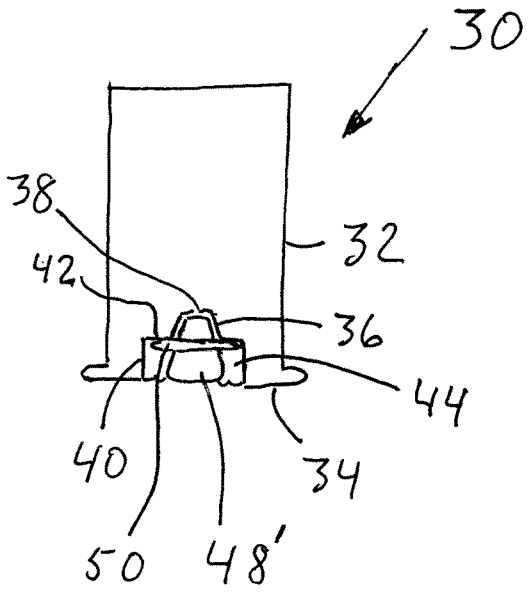
FIG. 13 is a side sectional view in elevation of the bullet casing shown in FIG. 7 with a flanged primer secured in the primer bore/counter-bore configuration with the primer flange secured in the primer counter-bore and surrounded by adhesive.

As shown in FIG. 13, when a modified primer 48' is inserted into the bullet cartridge 30 embodiment shown in FIG. 7, primer flange 50 registers against the bottom surface 42 of primer counter-bore 40. When adhesive is applied to the counter-bore, the primer is mechanically locked into the counter-bore via the adhesive after cure. Any attempt to dislodge a spent primer secured in this manner will result in the removal tool penetrating the top of the primer without removing the primer from the bullet cartridge. Any attempt to scrape out the adhesive will fail due to the aggressiveness of the adhesive and the mechanical lock provided by the primer flange.

Figure 14:
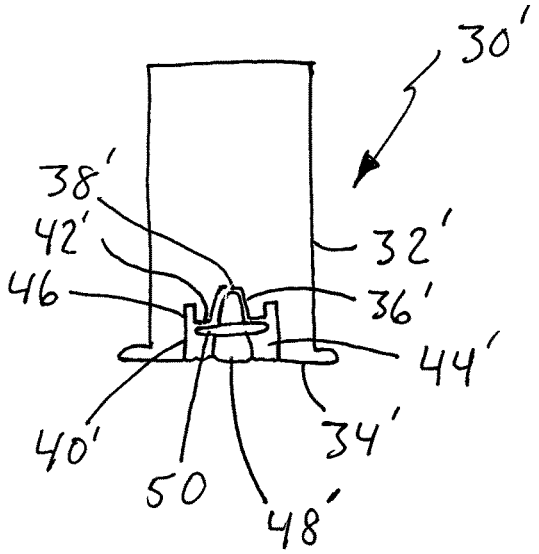
FIG. 14 is a side sectional view in elevation of the bullet casing shown in FIG. 9 with a flanged primer secured in the primer bore/annularly extended counter-bore configuration with the primer flange secured in the primer counter-bore and surrounded by adhesive in the counter bore and annular counter-bore extension.

Referring now to FIG. 14, when a modified primer 48' is inserted into the bullet cartridge 30' embodiment shown in FIG. 9, primer flange 50 registers against the bottom surface 42' of primer counter-bore 40'. When adhesive is applied to the counter-bore and vertical counter-bore extension 46, the primer is embedded into the adhesive and mechanically locked into the counter-bore via the adhesive after cure. Like the embodiment shown in FIG. 13, any attempt to dislodge a spent primer secured in this manner will result in the removal tool penetrating the top of the primer without removing the primer from the bullet cartridge. Any attempt to scrape out the adhesive will fail due to the aggressiveness of the adhesive and the mechanical lock provided by the primer flange and the vertical counter-bore extension.

Figure 15:
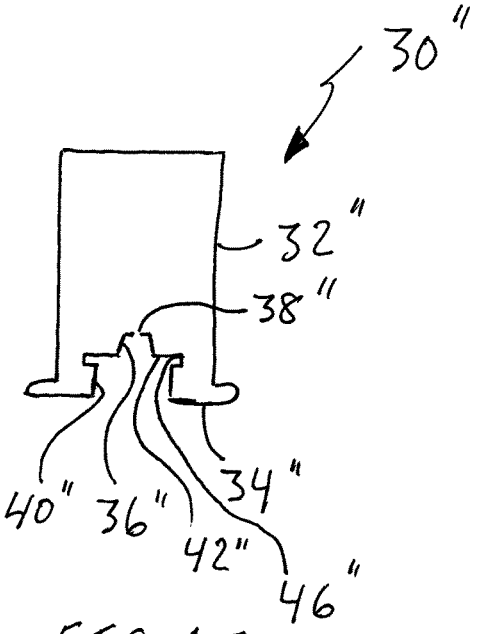
FIG. 15 is a side sectional view in elevation of a bullet casing with a primer counter-bore and a radial counter-bore extension according to a yet further embodiment of the disclosure.
Figure 16:
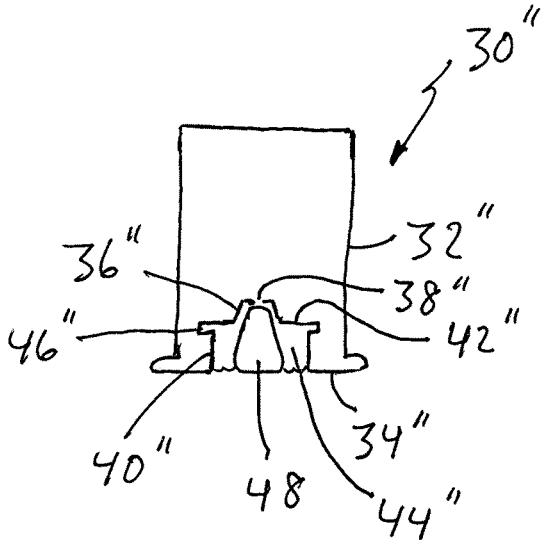
FIG. 16 is a side sectional view in elevation of the bullet casing shown in FIG. 15 with a primer secured in the primer bore surrounded by adhesive in the primer counter-bore and radial counter-bore extension.

Referring now to FIGS. 15 and 16, in yet another aspect of the disclosure, a bullet cartridge 30" includes a cylindrical cartridge wall 32" secured to a cartridge base 34". The combination of the cartridge wall and cartridge base form an open chamber configured to receive granular explosive materials. A primer bore 36" is formed in cartridge base 34" and defines a primer through-bore 38" that permits communication between the contents of a primer secured to the bullet cartridge and the open chamber.

A primer counter-bore 40" is formed superposed about primer bore 36" with a counter-bore base 42" dimensionally set to be shallower than the depth of primer bore 36". In this embodiment, a radial bore extension 46" is formed along the perimeter of primer counter-bore 40" and extends radially outwardly from the junction of the counter-bore sidewall and counter-bore bottom surface 42". Radial bore extension 46" creates an annular counter-bore wall extension filled with adhesive that enhances the structural and functional strength of the adhesive.

As shown in FIG. 16, when a conventional primer 48 is secured in primer bore 36", adhesive 44" is placed in primer counter-bore 40" and radial bore extension 46" to further secure primer 48 to cartridge base 34". Once adhesive 44" cures, the added adhesive in radial bore extension 46" increases the strength or "hold" of the adhesive to the cartridge base by providing an additional mechanical interference fit. This construction is again designed to thwart any attempts to chip out the cured adhesive with sharp implements such as awls. Attempted removal of a spent primer should produce the same results as disclosed for the bullet cartridge 30 and 31 embodiments. Either the spent primer is only partially removed, or fully removed with an asymmetric section of cured adhesive. The remaining primer bore is now either partially occluded by any remaining primer segments, or rendered asymmetrical due to adhesive tear-out. In either condition, the bullet cartridge is rendered unusable as a new primer cannot be inserted successfully in an asymmetric or occluded primer bore.

Figure 17:
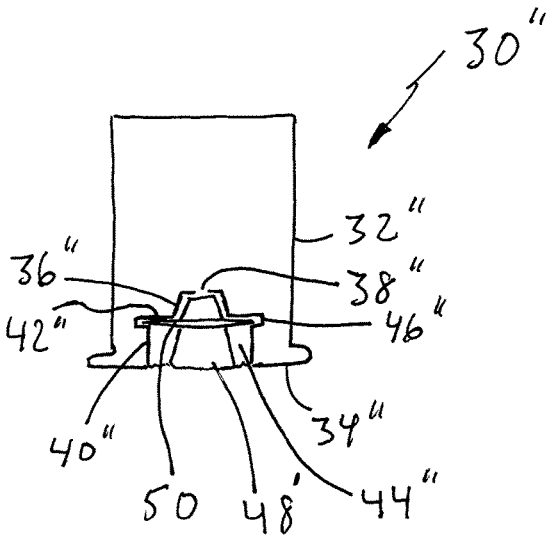
FIG. 17 is a side sectional view in elevation of the bullet casing shown in FIG. 15 with a flanged primer secured in the primer bore and the primer flange secured in the primer counter-bore/radial counter-bore extension and embedded in adhesive.

Referring now to FIG. 17, bullet cartridge 30" shown with flanged primer 48' secured thereto. When flanged primer 48' is secured in primer bore 36", flange 50 flexes into, registers against, and mechanically locks with, radial counter-bore extension 46". Adhesive 44" is placed in primer counter-bore 40" and radial bore extension 46" to further secure primer 48' to cartridge base 34". Once adhesive 44" cures, the added adhesive in radial bore extension 46" locks onto primer flange 50 and increases the strength or "hold" of the adhesive to the cartridge base by providing an additional mechanical interference fit beyond that provided by the combination of bullet cartridge 30' and flanged primer 48'. This construction is again designed to thwart any attempts to chip out the cured adhesive with sharp implements such as awls. Attempted removal of a spent primer should produce the same results as disclosed for the bullet cartridge 30 and 31 embodiments. Either the spent primer is only partially removed, or fully removed with an asymmetric section of cured adhesive. The remaining primer bore is now either partially occluded by any remaining primer segments, or rendered asymmetrical due to adhesive tear-out. In either condition, the bullet cartridge is rendered unusable as a new primer cannot be inserted successfully in an asymmetric or occluded primer bore.

Figure 18:
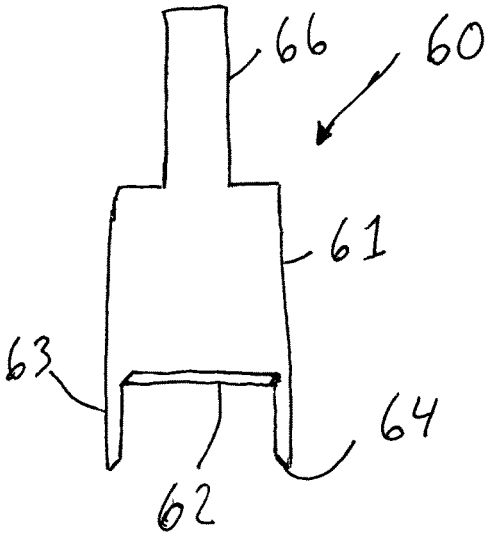
FIG. 18 is a side sectional view of a vertical bore extension boring bit according to yet another embodiment of the disclosure.

Regarding construction of any of the bullet cartridge embodiments disclosed herein, most can be created with the use of drilling implements such as those used in a Davenport apparatus as is well known in the art. Regarding the vertical counter-bore extension of bullet cartridge 30', there are at least two methods to create the bore extension. In a first method, a two-step process is used in which the counter-bore is first drilled with a drill bit to a desired depth. Following retraction of the drill bit, a core bit is used to create the annular vertical bore extension. In a second, method, a combination bit, as shown in FIG. 18, is used. Combination bit shown generally as 60 has a main bit body 61 that extends from a bit shaft 66. A cutting edge 62 is formed on a bottom surface of bit 60. An annular peripheral bit extension 63 extends downwardly from main body 61. The radial thickness of peripheral bit extension 63 determines the width of the vertical counter-bore extension. The length of peripheral bit extension 63 determines the depth of the vertical counter-bore extension. A distal end of extension 63 is formed with a peripheral cutting edge 64. As will be immediately understood by those having skill in the art, when combination bit 60 is lowered onto a bullet cartridge base, peripheral bit extension 63 begins the boring process by creating the sidewall of the counter-bore. The bit is lowered until cutting edge 62 reaches the desired depth.

Figure 19:
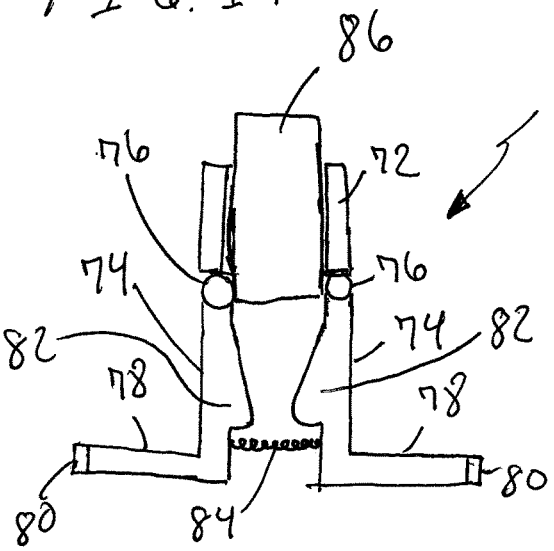
FIG. 19 is a side sectional view in elevation of a radial bore extension boring bit in a contracted position according to a still further embodiment of the disclosure.
Figure 20:
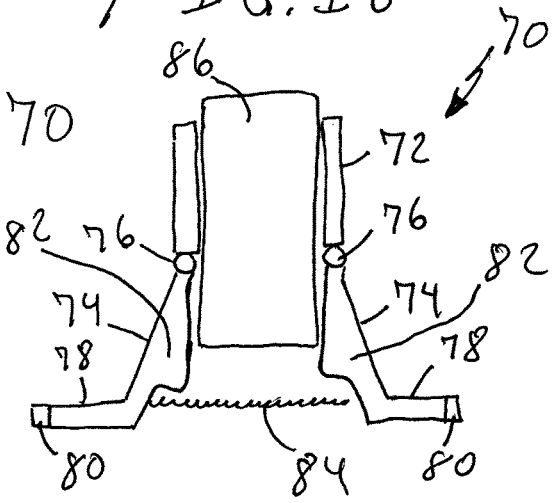
FIG. 20 is a side sectional view in elevation of the radial bore extension boring bit shown in in FIG. 19 in an extended position.

With respect to formation of the counter-bore with radial counter-bore extension, a two-step process is needed. A conventional boring bit is used to form the primer counter-bore. The boring bit is elevated after the desired counter-bore depth is achieved. This is followed by radial counter-bore extension bit shown generally as 70 in FIGS. 19 and 20. Bit 70 includes a hollow shaft 72 with two or more radial cutting segments 74. Segments 74 are attached to shaft 72 via hinges 76. Each segment 74 has a radial extension 78 with a radial extension cutting edge 80 formed on a distal end. An inner wall of segment 74 is formed with a sloped shoulder 82. A tension spring 84 is secured to the inner walls of segments 74 to maintain the segments in a retracted position.

A bit plunger 86 is dimensioned to fit within hollow shaft 72 and may have a tension spring attached thereto to maintain the plunger in an up, disengaged position. To use bit 70, the bit is lowered into a pre-drilled bore having a diameter approximately equal to the diameter of the space occupied by the radial extensions 78 of segments 74. When bit 70 has reached the bottom of the pre-drilled bore, e.g., primer counter-bore 40", the bit is rotated and plunger 86 is driven down into the space between the segments 74. As plunger 86 registers against the sloped shoulders 82 of segments 74, the radial extensions 78 are urged into the sidewall of the counter-bore. Cutting edges 80 cut into the sidewall and create the counter-bore radial extension. The radial depth of the radial counter-bore extension is determined by the degree of slope of the sloped shoulders, the length of the shoulders and the travel distance of the plunger. The greater the slope, the greater the slope length and the greater the plunger distance travel when inserted into the segments 74, the deeper the radial counter-bore extension. Retraction of plunger 86 releases the radial pressure on the segments and tension spring 84 pulls segments 74 back to a retracted position. The bit can then be retracted from the primer counter-bore.

While the present disclosure has been described in connection with several embodiments thereof, it will be apparent to those skilled in the art that many changes and modifications may be made without departing from the true spirit and scope of the present disclosure. Accordingly, it is intended by the appended claims to cover all such changes and modifications as come within the true spirit and scope of the disclosure.

What we claim as new and desire to secure by United States Letters Patent is:

1. A bullet cartridge comprising:

a cylindrical cartridge wall;

a cartridge base secured to an end of the cartridge wall, wherein a primer bore is formed in the cartridge base, and wherein the primer bore has a perimeter to form a primer bore registration surface;

a counter-bore formed in the cartridge base superposed about the primer bore, wherein the counter-bore has an annular counter-bore bottom surface substantially parallel with the cartridge base that defines the perimeter of the primer bore;

a primer secured in the primer bore and registered against the primer bore registration surface; and, an epoxy deposited in the counter-bore about the primer, wherein the epoxy binds aggressively to the primer and the counter-bore to lock the primer to the cartridge base, wherein removal of the primer from the cartridge base causes a structural asymmetry to be formed in the cartridge base to render the cartridge unusable for reuse.

2. The bullet cartridge of claim 1 further comprising a vertical counter-bore extension, wherein the adhesive is positioned also in the vertical counter-bore extension.

3. The bullet cartridge of claim 1 further comprising a radial counter-bore extension, wherein the adhesive is positioned also in the radial counter-bore extension.

4. The bullet cartridge of claim 1 wherein the primer is a flanged primer having an annular flange extending radially from an exterior sidewall of the primer.

5. The bullet cartridge of claim 1 wherein the counter-bore is annular.

6. The bullet cartridge of claim 1 wherein the counter-bore is concentric with, and shares the same longitudinal axis as, the primer bore.

7. The bullet cartridge of claim 1 wherein the counter-bore is asymmetrically positioned about the primer bore.

8. The bullet cartridge of claim 7 wherein the counter-bore is formed with a regular or irregular geometric sidewall.

9. The bullet cartridge of claim 1 wherein the counter-bore is formed with a regular geometric sidewall.

10. The bullet cartridge of claim 1 wherein the counter-bore is dimensioned to be shallower in depth than the primer bore.

11. The bullet cartridge of claim 1 further comprising micro-voids formed between the primer and the primer bore registration surface.

12. The bullet cartridge of claim 11 wherein the adhesive fills the micro-voids to produce a water-proof bullet cartridge.

* * * * *